United States Patent [19]

Ramsay et al.

[11] Patent Number: 4,998,657

[45] Date of Patent: Mar. 12, 1991

[54] APPARATUS FOR THE INTERMITTENT FORWARD FEEDING OF A MATERIAL WEB PROVIDED WITH TRANSVERSE CREASE LINES

[75] Inventors: George Ramsay, King, Canada; Arne Klint, Vellinge, Sweden

[73] Assignee: AB Tetra Pak, Lund, Sweden

[21] Appl. No.: 404,573

[22] Filed: Sep. 8, 1989

[30] Foreign Application Priority Data

Sep. 14, 1988 [SE] Sweden ..... 8803235

[51] Int. Cl.[5] ..... B65H 23/04

[52] U.S. Cl. ..... 226/52; 226/122; 226/123; 226/152; 226/87

[58] Field of Search ..... 226/52, 76–77, 226/87, 120, 122, 123, 152, 168; 83/423

[56] References Cited

U.S. PATENT DOCUMENTS

| | | | |
|---|---|---|---|
| 2,119,336 | 5/1936 | Holland-Letz | 83/423 X |
| 3,929,045 | 12/1975 | Palsson | 83/323 |
| 4,022,365 | 5/1977 | Weller | 226/87 X |
| 4,351,461 | 9/1982 | Carlsson | 226/52 X |
| 4,401,250 | 8/1983 | Carlsson | 226/35 X |
| 4,838,468 | 6/1989 | Lesse | 226/76 |

FOREIGN PATENT DOCUMENTS 0121276 10/1984 European Pat. Off. .

*Primary Examiner*—Daniel P. Stodola
*Assistant Examiner*—Paul Thomas Bowen
*Attorney, Agent, or Firm*—Burns, Doane, Swecker & Mathis

[57] ABSTRACT

An apparatus for feeding a material web includes a four-winged driving reel for intermittently feeding the material web in the forward direction. The four wings include two longer wings and two shorter wings. The distance between the free ends of adjacent wings is substantially equal to the distance between crease lines on the material web.

8 Claims, 3 Drawing Sheets

APPARATUS FOR THE INTERMITTENT FORWARD FEEDING OF A MATERIAL WEB PROVIDED WITH TRANSVERSE CREASE LINES

FIELD OF THE INVENTION

The present invention relates to an apparatus for feeding a material web. More particularly the present invention relates to an apparatus for the intermittent forward feeding of a material web that is provided with transverse crease lines.

BACKGROUND OF THE INVENTION

Machines for the continuous manufacture of filled and sealed packages from a moving material web are known. The material web consists of a liquid-tight laminate, preferably paper laminated with plastics. The material web is provided before it is introduced into the machine with transverse crease lines intended of the web into facilitate the subsequent forming to final packages. It is also known for such a web to be kept in register which is necessary so that the decoration will always appear in the same position on the package. It is also necessary to keep the web in register for possible punching operations or applications of strip onto the material web.

Such material webs are fed forward through the machine continuously or intermittently. In case it is desired to provide the package with an opening arrangement located on the outside of the material web, a so-called pull-tab, the moving material web has to be punched and provided with an opening strip located on the outside, which implies that the movement of the material web has to be stopped during these working processes. The intermittent driving up to now has been done via a two-bladed driving reel, where the wing points of the driving reel engage the crease lines and in this manner guide the material web. In each working cycle one or more package lengths are fed forward for punching and strip application. This two-bladed driving reel, however, causes strong jerks in the material web on starting which results in difficulties with respect to trying to keep the web in register. Likewise it has been difficult to stop the web in its stretched condition due to the fact that the material web, because of its high speed, will continue to move after the driving has stopped.

OBJECTS AND SUMMARY OF THE INVENTION

It is an objection of the present invention to eliminate the abovementioned disadvantages and to provide an apparatus for the intermittent forward feeding of a material web in which the web accelerates slowly and smoothly without jerks, and where a controlled retardation is achieved which contributes to maintaining the web in the stretched condition.

It is a further object of the present invention to ensure that the intermittent forward feeding in an operationally reliable manner can take place with the web in register.

These and other objects have been achieved in accordance with the invention in that the apparatus is constructed such that two of the wings of the four-winged driving reel are longer than the remaining two wings.

BRIEF DESCRIPTION OF THE DRAWINGS

The invention will now be described in more detail with reference to the attached drawings, wherein.

FIGS. A–D illustrate the manner driving reel moves during a working cycle.

DETAILED DESCRIPTION OF THE PREFERRED EMBODIMENT

Figure 1:
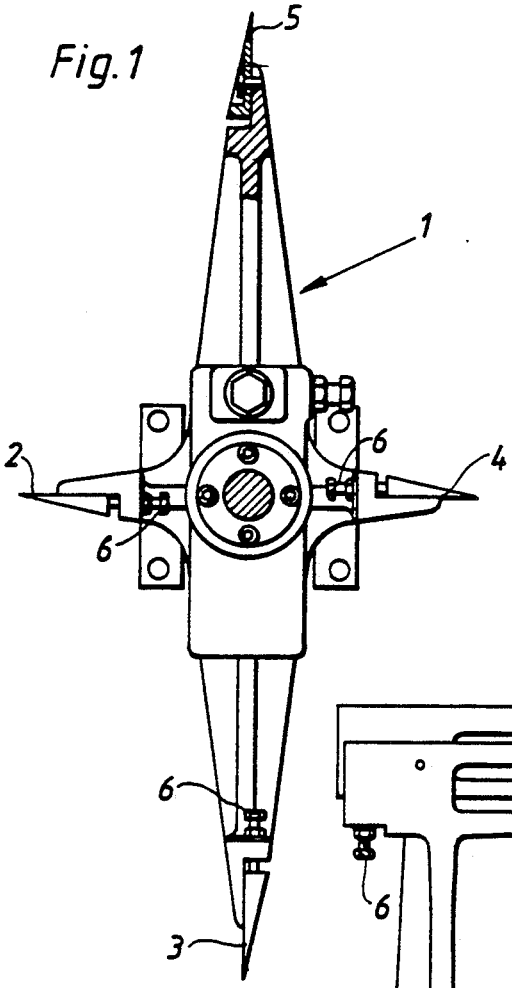
FIG. 1 is a front view of the four-winged reel.

FIG. 1 shows a view from the front of the driving reel 1 with two long 3,5 and two short 2,4 wings where the two longer wings 3,5 are at least twice as long as the two shorter wings 2,4. The wings are placed so that two adjoining wings are oriented 90° in relation to each other, and so that the two shorter wings 2,4 are oriented 180° in relation to each other. The distance between two adjoining wing points corresponds to the distance between two transverse crease lines on the material web which corresponds to a package length. This distance can be adjusted with the help of set screws 6 when different package lengths are used.

Figure 2:
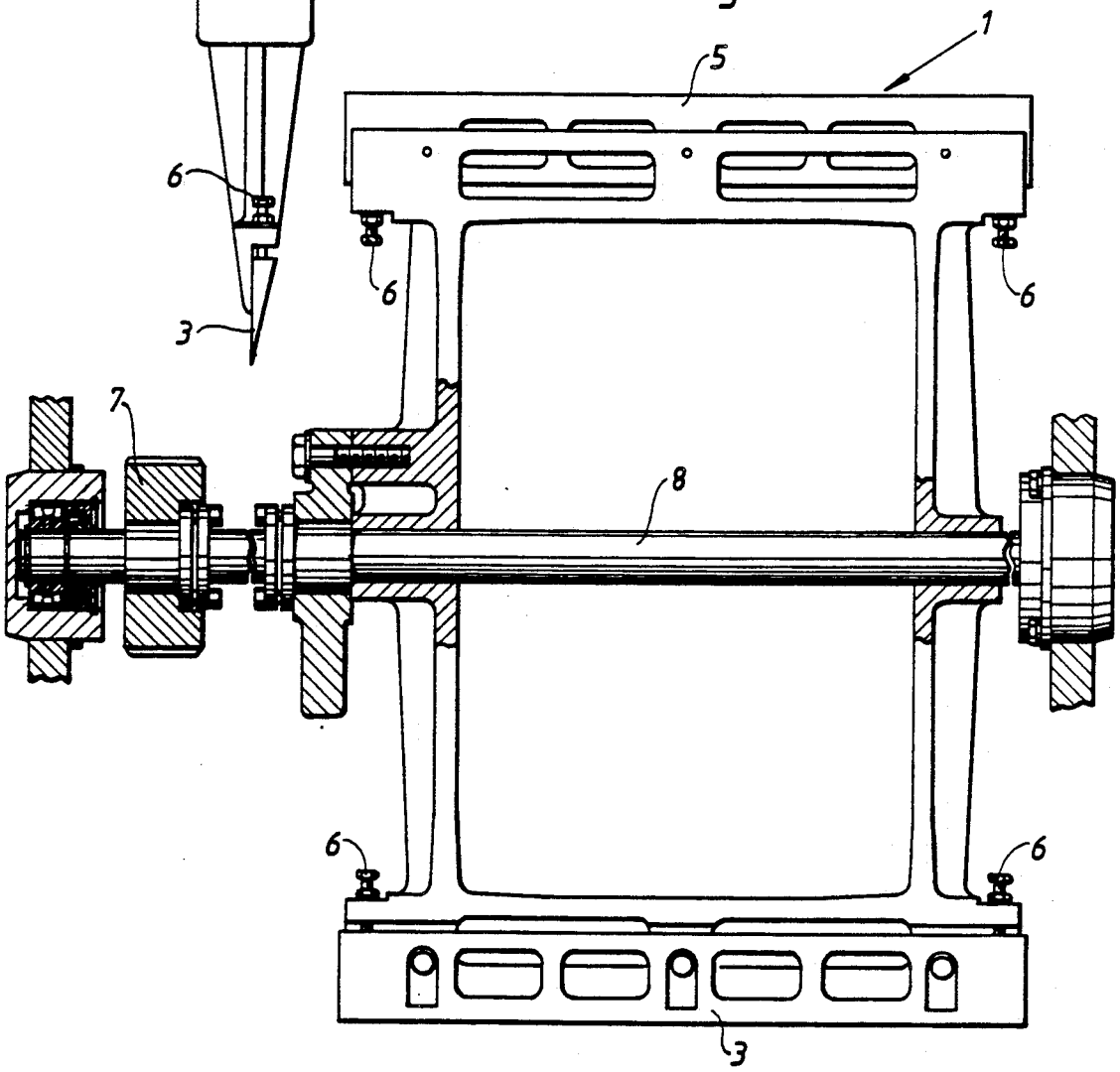
FIG. 2 is a side view, partially in cross-section, of the reel shown in FIG. 1.

FIG. 2 shows the same driving reel 1 in a partial cross-section with a driving arrangement 7 and a driving shaft 8. The extension of the wings 3,5 in the lateral direction corresponds to the width of the material web.

Figure 3:
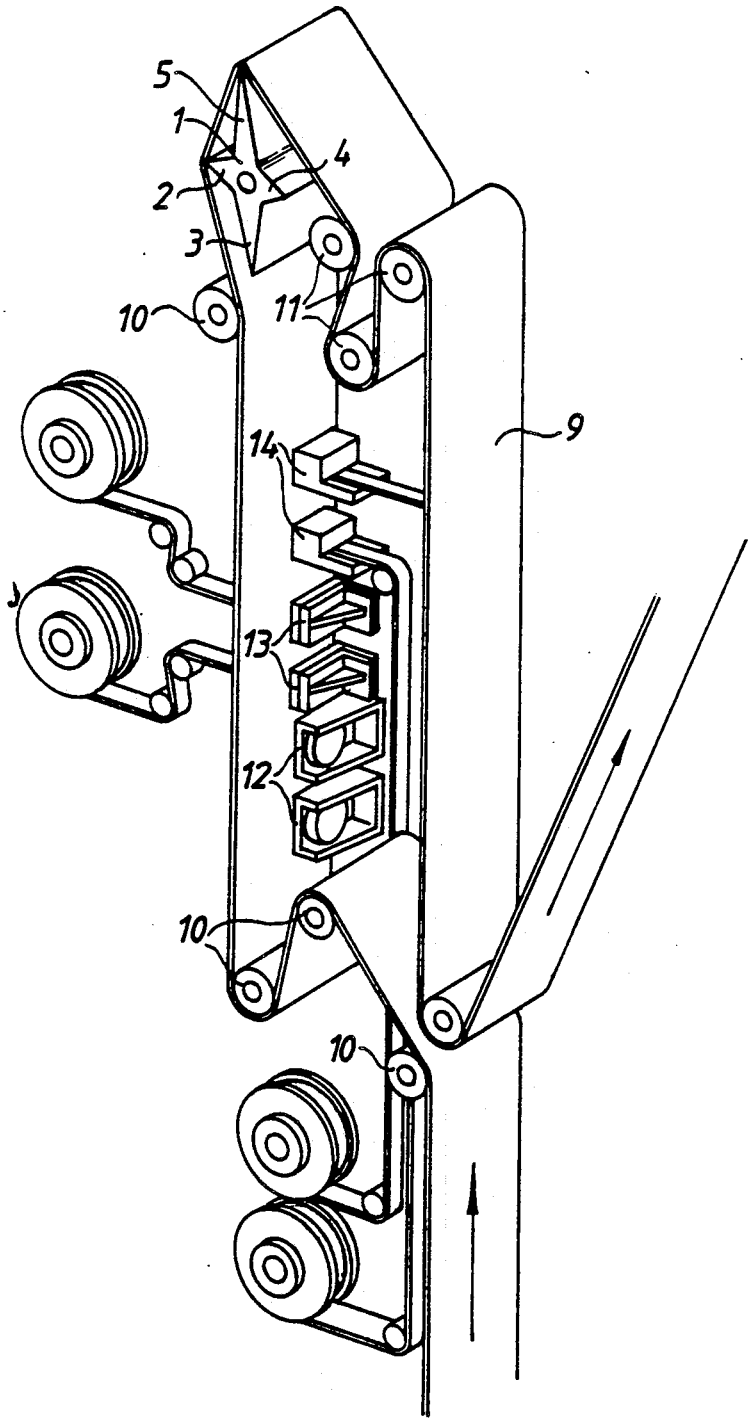
FIG. 3 is a schematic view of the four-winged reel positioned in the packing machine. The drawing only shows the details necessary for an understanding of the invention.

FIG. 3 shows schematically how the four-winged driving reel 1 is placed in the packing machine. The moving web of packing material 9 is conducted via supporting rollers 10 over the driving reel 1 and subsequently via deflection rollers 11 further into the packing machine. As the distance between two adjoining wing points on the driving reel 1 corresponds to a package length on the material web, the driving reel 1 feeds forward two package lengths every time it moves over 180°.

Upstream of the reel 1 are placed punching tools and working stations 13,14 for the application of strips necessary for providing the package length with a tear-off opening arrangement, a so-called pull tab which is located on the outside of the packages. Other forms of working stations too are conceivable upstream or downstream of the driving reel.

Figure 4A:
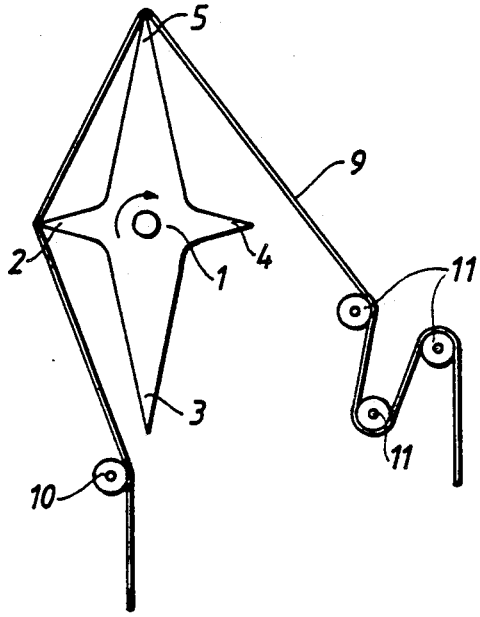
Figure 4B:
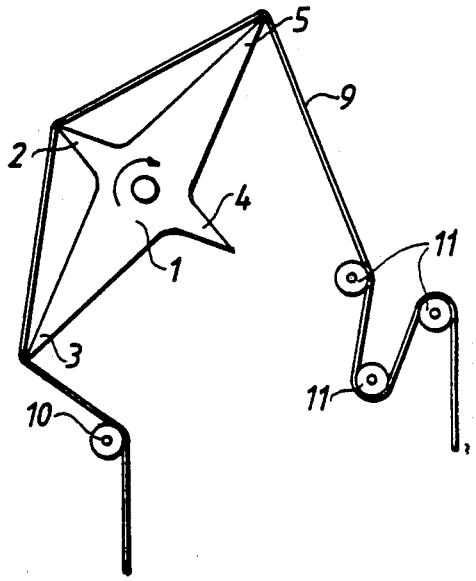
Figure 4C:
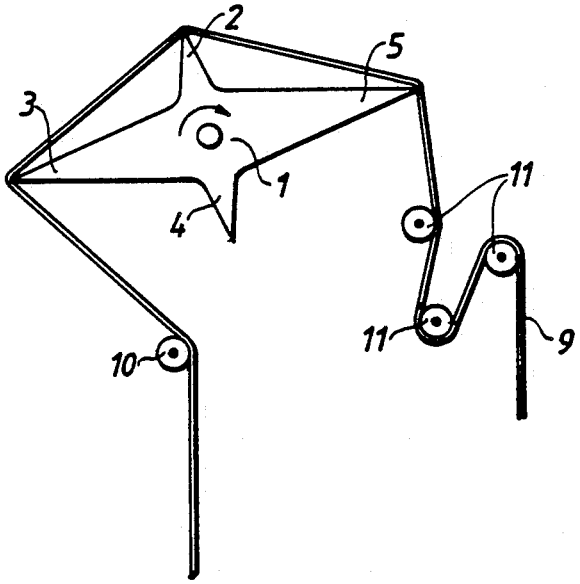
Figure 4D:
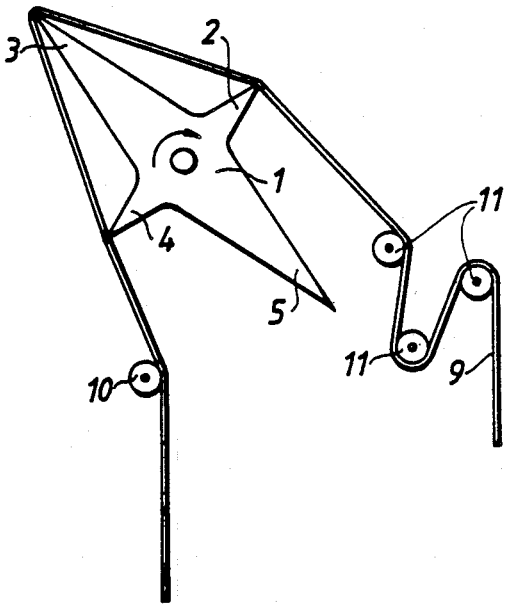

The driving reel 1 operates intermittently and in each working cycle moves 180° about its shaft 8. In the rest position (FIG. 4A) two wings 2,5 are in contact with the material web 9. When the driving reel 1 starts from the rest position (FIG. 4B) the shorter wing 2, which is in contact with the web, commences to draw the material web 9 forward. Since, during rotation of the arrangement the shorter wings 2,4 have an appreciably lower peripheral speed than the longer wings 3,5, the web 9 starts relatively slowly and smoothly. Thereafter (FIG. 4C) the longer wing 3 makes contact with the web 9 and with increased speed the required material length is rapidly drawn forward. Directly before the driving reel 1 stops (FIG. 4D) the next following shorter wing 4 has come into contact with the material web 9 and by its shorter length contributes to slowing the movement of the web whereupon stops the material web in stretched condition. When the driving reel 1 is at a standstill the desired working action is carried out whereupon the driving reel 1 starts again and draws two package lengths forward.

As is evident from the above description, the present invention brings about an apparatus for the intermittent forward feeding forwards of a moving material web provided with transverse crease lines which permits the moving web to accelerate accelerated smoothly and without jerks, thereby contributing to keeping the web stretched when the driving wheel ceases to draw the material forward.

While this invention has been illustrated and described in accordance with a preferred embodiment, it is recognized that variations and changes may be made and equivalents employed herein without departing from the invention as set forth in the claims.

What is claimed is:

1. An apparatus for intermittently feeding in a forward direction a material web which has transverse crease lines defining a package length, comprising:

a driving shaft;

a driving wheel mounted on the driving shaft, said driving wheel including four wings that extend radially outwardly with respect to the driving shaft, each of said wings having a free end located distally from the driving shaft, the distance between the free ends of adjacent wings being substantially equal to the distance between two crease lines on the material web, said four wings including two longer wings and two shorter wings, the two longer wings being longer than the two shorter wings, the distance between the free end of at least one of the longer wings and the free ends of the two adjacent shorter wings being substantially equal.

2. The apparatus according to claim 1, wherein the two longer wings are substantially the same length and the two shorter wings are substantially the same length, the two longer wings being substantially twice as long as the shorter wings.

3. The apparatus according to claim 1, wherein each of said four wings includes adjusting means for adjusting the length of the respective wing.

4. The apparatus according to claim 3, wherein each of said wings includes a separate movable free end portion and a screw connected to the movable free end portion, said movable free end portion and said screw defining said adjusting means.

5. The apparatus according to claim 1, wherein adjacent wings are spaced apart from each other by approximately 90.

6. The apparatus according to claim 1, wherein said two longer wings are spaced apart from each other by approximately 180° and said two shorter wings are spaced apart from each other by approximately 180°.

7. The apparatus according to claim 1, including supporting rollers positioned upstream of the driving reel and driving shaft with respect to the forward direction.

8. The apparatus according to claim 1, including deflection rollers positioned downstream of the driving reel and drive shaft with respect to the forward direction.

* * * * *